US008257579B2

(12) United States Patent
Barrero et al.

(10) Patent No.: US 8,257,579 B2
(45) Date of Patent: Sep. 4, 2012

(54) METHOD FOR THE WELL-HEAD TREATMENT OF HEAVY AND EXTRA-HEAVY CRUDES IN ORDER TO IMPROVE THE TRANSPORT CONDITIONS THEREOF

(75) Inventors: Rigoberto Barrero, Piedecuesta (CO); Luz Edelmira Afanador, Piedecuesta (CO); Gonzalo Leal, Piedecuesta (CO); Jorge Luis Grosso, Piedecuesta (CO); Martha Parra, Piedecuesta (CO); Claudia Esneiden Cuadrado, Piedecuesta (CO); Humberto Vidales, Piedecuesta (CO); Erika Guzman, Piedecuesta (CO); Lilia Rodriguez, Piedecuesta (CO)

(73) Assignee: Ecopetrol S.A., Bogota (CO)

( * ) Notice: Subject to any disclaimer, the term of this patent is extended or adjusted under 35 U.S.C. 154(b) by 194 days.

(21) Appl. No.: 12/738,796

(22) PCT Filed: Oct. 17, 2008

(86) PCT No.: PCT/IB2008/002996

§ 371 (c)(1),
(2), (4) Date: Aug. 12, 2010

(87) PCT Pub. No.: WO2009/050582

PCT Pub. Date: Apr. 23, 2009

(65) Prior Publication Data

US 2010/0300931 A1 Dec. 2, 2010

(30) Foreign Application Priority Data

Oct. 18, 2007 (CO) ..... 07109910

(51) Int. Cl.

| | |
|---|---|
| ***C10C 3/08*** | (2006.01) |
| ***C10G 21/14*** | (2006.01) |
| ***C10G 21/28*** | (2006.01) |
| ***C10G 33/04*** | (2006.01) |

(52) U.S. Cl. ..... 208/309; 208/45; 208/187; 208/188; 208/290

(58) Field of Classification Search ..... 208/45, 208/187, 188, 290, 309
See application file for complete search history.

(56) References Cited

U.S. PATENT DOCUMENTS

| | | | | | |
|---|---|---|---|---|---|
| 456,623 | A | | 7/1891 | Lane | |
| 2,221,161 | A | | 12/1940 | Anne et al. | |
| 2,337,448 | A | | 12/1943 | Carr | |
| 3,065,859 | A | | 11/1962 | Muench | |
| 3,684,699 | A | * | 8/1972 | Vermeulen et al. | 208/188 |
| 4,125,459 | A | | 11/1978 | Garwin | |
| 4,191,639 | A | | 3/1980 | Audeh et al. | |
| 4,324,651 | A | | 4/1982 | Rollmann et al. | |
| 4,514,287 | A | | 4/1985 | Ikematsu et al. | |
| 4,528,068 | A | | 7/1985 | Fiocco et al. | |
| 4,634,520 | A | * | 1/1987 | Angelov et al. | 208/188 |
| 4,781,819 | A | * | 11/1988 | Chirinos et al. | 208/188 |
| 4,810,367 | A | | 3/1989 | Chombart et al. | |
| 5,059,300 | A | | 10/1991 | McGinnis | |
| 5,843,303 | A | | 12/1998 | Ganeshan | |
| 6,357,526 | B1 | | 3/2002 | Abdel-Halim et al. | |
| 6,533,925 | B1 | | 3/2003 | Wallace et al. | |
| 2005/0167333 | A1 | | 8/2005 | McCall et al. | |
| 2006/0027488 | A1 | | 2/2006 | Gauthier | |

FOREIGN PATENT DOCUMENTS

| | | |
|---|---|---|
| EP | 0 134 088 | 3/1985 |
| GB | 1175028 | 12/1969 |
| WO | WO 2005/074440 | 8/2005 |

* cited by examiner

*Primary Examiner* — Randy Boyer
(74) *Attorney, Agent, or Firm* — Merchant & Gould P.C.

(57) ABSTRACT

The invention relates to a method for the dehydration of, and in-line removal of asphaltenes from, heavy and extra-heavy crudes. The method is performed at the well head at pressures of between 414 and 689 KPa and temperatures of between 60 and 100° C. and includes two phases, namely a dehydration phase and a deasphalting phase. The first phase includes the addition of solvent, removal of free water, heating, addition of emulsion breakers and settling for removal of emulsified water. The asphaltenes are extracted in the second phase. Said phase comprises the use of low-force in-line static mixers and contactors having a specific design and a sedimentation device with specific internal arrangements for separation. The recovered solvent is recirculated into the method, the improved crude is separated and the asphaltenes are used as fuel for cogeneration which supplies the energy requirements for production and the improvement method.

12 Claims, 6 Drawing Sheets

Figure 2. Solvent Composition
Λ%
60
50
40
30
20
10
0
Paraffins
Isoparaffins
Aromatics
Naphtenes
Olefines
C12+
Components Figure 3. Simulated Solvent destilation Figure 5. Crude Oil Adding Systems
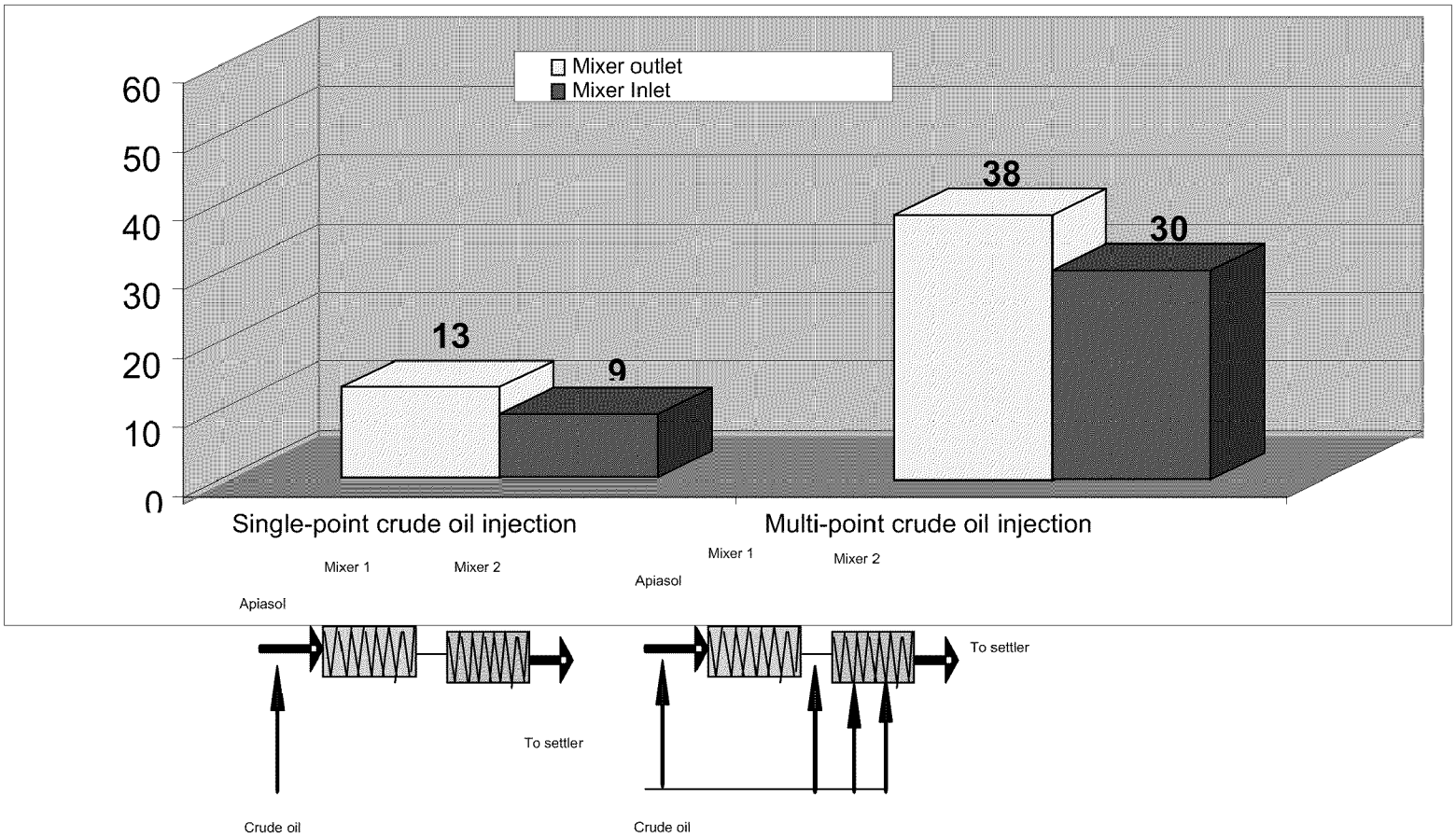

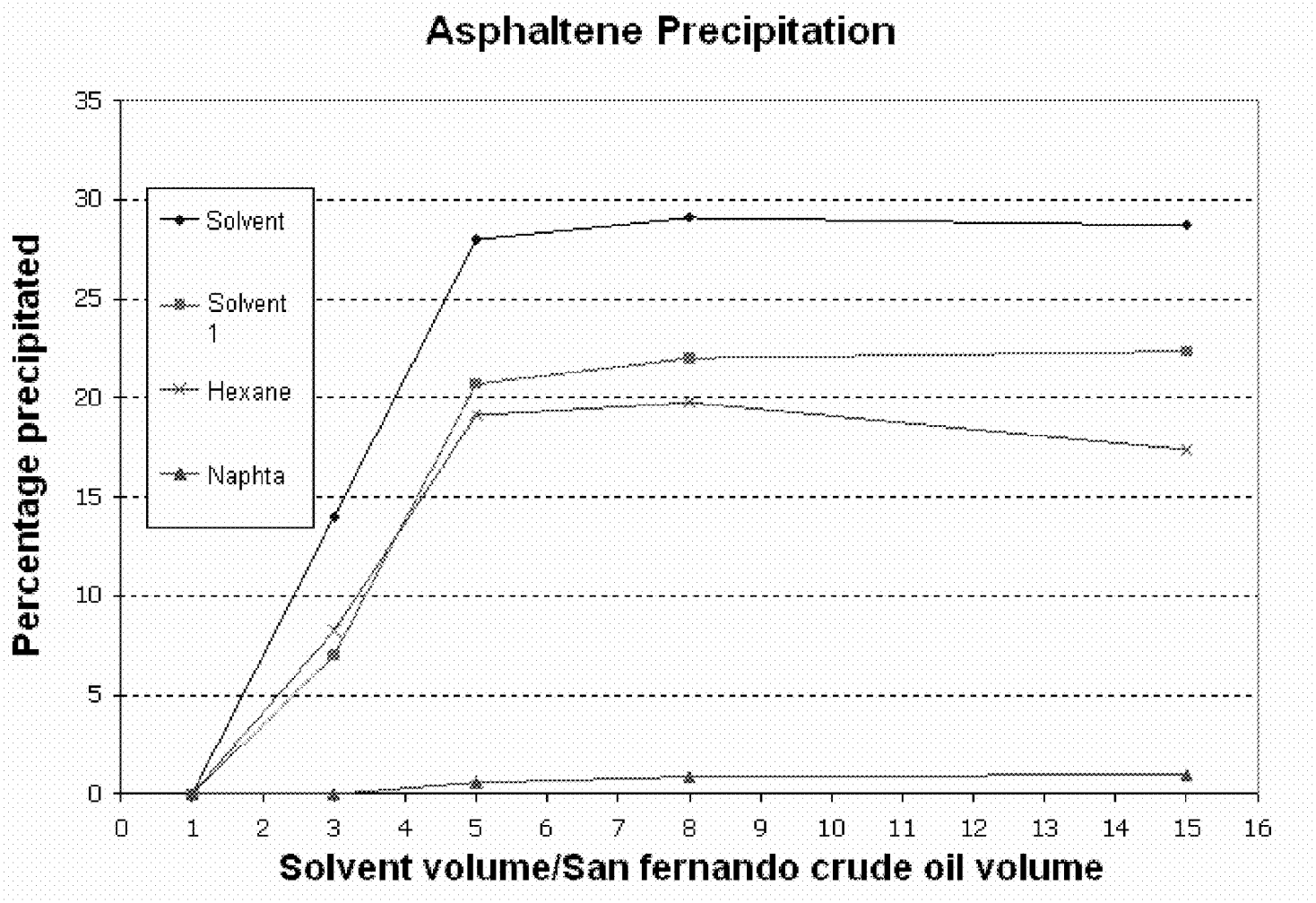
Figure 6. Evaluation of different solvents for San Fernando crude oil

METHOD FOR THE WELL-HEAD TREATMENT OF HEAVY AND EXTRA-HEAVY CRUDES IN ORDER TO IMPROVE THE TRANSPORT CONDITIONS THEREOF

TECHNOLOGICAL FIELD

This application is a National Stage Application of PCT/IB2008/002996, filed 17 Oct. 2008, which claims benefit of Serial No. 07-109910, filed 18 Oct. 2007 in Colombia and which applications are incorporated herein by reference. To the extent appropriate, a claim of priority is made to each of the above disclosed applications.

The present invention refers to a continuous upgrading process for heavy and extra heavy crude oils applied in petroleum production, which allow dehydration, reduce the viscosity of the crude oil making transportation via pipelines easier, and decreasing the content of sulfur and metals to make refining viable under conventional schemes.

The heavy and extra heavy crude oils are constituted of long hydrocarbon chains with high contents of asphaltenes. These asphaltenes give them a high viscosity that difficult transportation through pipelines. In addition, these long hydrocarbons chains contain sulfur and metals such as nickel and vanadium which interfere by poisoning the catalysts used in catalytic cracking processes. Consequently, it is important to reduce these pollutants prior to refining. The deasphalting processes remove a percentage of these pollutants and reduce the viscosity of the crude oils, thus allowing its transportation through pipelines. This allows reducing the transportation and refining costs, increasing the value of heavy and extra heavy crude oils.

STATE OF THE ART

The state of the art reveals that there are several processes related with the deasphalting of residues resulting from the atmospheric and vacuum distillation processes, and the deasphalting processes for heavy and extra heavy crude oils which is the objective of the present invention. U.S. Pat. No. 2,337,448, describes a process for removing sulfur from the residues going to the coking process. At first, a deasphalting process with solvent is applied to these residues, and the asphaltenes obtained, with softening points higher than 350° F. (177° C.), are subjected to high temperature conditions (675° F. (357° C.)) so as to remove sulfur from the asphaltenes as a gas ($H_2S$). The desulfured bottoms are then subjected to a coking process where the vapors are removed and are then condensed as light products. This patent presents a different process to the proposed by the present patent application and works at a higher temperature range.

U.S. Pat. No. 4,125,459 is related with a hydrocarbon solvent treatment of bituminous materials and describes a process to deasphalt hydrocarbons obtained from bituminous material by deasphalting with propane and pentane combined, which can also be obtained by deasphalting with propane or with pentane. The bituminous material is first deasphalted with pentane to produce a light fraction containing oil and resins; said light fraction and a recycled material, consisting of a part of the fraction of the resins obtained from the second deasphalting process, is then subjected to a deasphalting process with propane. The process may also be performed by deasphalting, first with propane and then with pentane and recycling a part of the light fraction obtained to the deasphalting process with propane. According to the authors, the oil thus obtained is of higher quality and performance. The process claimed herein is performed at higher temperatures and pressures and with two types of solvents different to those in the proposed patent application.

U.S. Pat. No. 4,191,639, describes a deasphalting process with a mixture of at least two of the following compounds: hydrogen sulphide, carbon dioxide and light hydrocarbons such as propane, butane, pentane or mixtures thereof. Each of the components has to be present in at least 10% of what is called a solvent. The process occurs at a temperature below the solvent's critical temperature and at a pressure above the solvent's critical temperature. The hydrocarbon-solvent ratio may be from 1/1 to 1/20. The deasphalted oil is characterized by having lower sulfur and metals contents and can be used as feed for fluid catalytic cracking processes or hydrocracking processes.

This patent incorporates to the solvent different compounds to those presented in the instant patent application.

U.S. Pat. No. 4,324,651 describes a process for deasphalting a mineral oil containing asphalts, at a temperature above 80° C. (175-225° F.) and a high pressure (500-1200 Psig (3447,38 to 8273,71 KPag)), using methanol as a solvent to deasphalt. The process forms two phases: one rich in asphalt and other in methanol. By cooling the methanol-rich phase to a temperature below 80° C. for a period of time, two phases are produced: one rich in oil and the other in methanol. The present patent application works at lower pressure conditions and does not use alcohol as a solvent.

U.S. Pat. No. 4,514,287 relates a process for the solvent deasphalting of asphaltene-containing hydrocarbons. The process is carried out by mixing a solvent plus an aluminum or titanium sulfate metallic compound and alcohols. The process uses reduced crude oils from atmospheric distillation and is applied for a residue resulting from a Arab light crude oil and with an asphaltene lower than 5%. The present patent application does not use a mixture of alcohols and it is used for asphaltenes contents higher than the 5%.

The design of the equipment where the contact and separation of the asphaltenes from the improved crude oils-solvent mixtures take place is a very important part in deasphalting processes. U.S. Pat. No. 4,528,068 focuses on a process performed in an extraction tower and claims for the design of the internal arrangements of the tower to perform the extraction process. The present patent application uses a sedimentation system consisting of a conical-bottom cylinder which has internal arrangements to improve the sedimentation process.

There are several methods, as the one described in U.S. Pat. No. 456,623, to deasphalt heavy crude oils in which the crude oil is combined with a miscible solvent; then, such mixture is put into contact with gaseous carbon dioxide, which is an antisolvent, to separate the mixture in two phases: a light one containing the major amount of solvent and the deasphalted crude oil. The American US Patentes a different solvent and a different process than that presented in this application.

U.S. Pat. No. 4,634,520 describes a batch process at a laboratory level to simultaneously dehydrate and deasphalt heavy crude oil emulsions, using petroluem ether as the solvent. Once they mix the crude oil with the solvent they wait for the phases to settle; next, they remove the light phase containing the deasphalted crude oil and the majority of the solvent. The asphaltenes are washed again twice with the solvent and are introduced in a hot water bath to produce asphaltene agglomerates; som time is given to allow separation of the phases, and, then, the settled phase (asphaltenes and water) is taken to a hot bath to make the asphaltenes form agglomerates. Then, the agglomerated asphaltenes are removed from the hot water. The present patent application separates de asphaltenes in a flash tower melting them in order to recover the light hydrocabons carried by the asphaltenes.

U.S. Pat. No. 4,810,367, claims a process to deasphalt heavy hydrocarbons in two stages and with two types of solvents: one richer in C3 and the other in C5. During the first stage, the asphaltenes are precipitated and the supernatant stream of the separation process drags the resins. This current is then treated with the second solvent to separate the resins. In the process claimed by the inventors of the present invention, the deasphalting process is performed in a single stage at operating conditions different to those stated in U.S. Pat. No. 4,810,367.

U.S. Pat. No. 4,915,819 describes a treatment for batch dehydration, deasphalting, and deparaffining, of crude in a form of emulsion. The process reduces the viscosity of heavy crude oils by removing the asphaltenes and the heavy metals such as nickel and vanadium (for heavy crude oils,) and paraffin (for light hydrocarbons). It describes a method to remove asphaltenes and/or waxes from crude oil, wherein the method comprises the steps of putting the crude oil in contact with an organic solvent to dissolve the crude and precipitate the asphaltenes and/or waxes, separating de asphalteners and/or waxes from the crude oil and the solvent, and separating the solvent from the deasphalted crude oil. The solvent is recovered for further use. The asphaltene recovery is performed by putting them in contact with water. The present patent application claims for a continuous process that first dehydrates the crude, and then takes it to the deasphalting process. It uses static mixers to homogenize de mixture crude oil/solvent, a settler with internal arrangements to facilitate the asphaltenes separation process. Subsequently, these asphaltenes are taken to a flash tower where the solvent is removed and the deasphalted crude oil which is dragged by the asphaltenes, thus allowing the obtention of dry asphaltenes and improving the performance of the deasphalted crude oil obtained; the recovery of the solvents from the desalphalted crude oil is carried out on a distillation tower.

U.S. Pat. No. 5,059,300 presents a process related with the modification of the physical properties of asphalts by adding deasphalted bottoms and phosphoric acid. It is applied to bituminous materials or asphalt and comprises heating a mixture containing between 0.1 and 20% of phosphoric acid, 1 to 15% of deasphalted bottoms with solvent, and up to 100% bituminous material or asphalt obtained from a vacuum distillation tower, to a high temperature (200-800° F. (93, 3-427° C.)). The method modifies the physical properties such as the softening point and the penetration. The invention of the present application does not require phosphoric acid to perform the deasphalting.

The Colombian patent application No. 97-48663, titled "Process for deasphalting heavy crude oils containing large amounts of asphaltenes, at low pressure and temperature conditions" describes a continuous extraction process in line, at low pressure and temperature, high performance and minimum maintenance to partially deasphalt, demetallize, and desulfur asphaltenic hydrocarbon mixtures such as asphaltenic heavy crude oils and heavy residues obtained from a primary vacuum distillation, either at their original state or in the form of inverse emulsions, hydrocarbons in water. The process mentioned in application 97-48663 occurs in one single stage, where, first, a beheading to separate the heavier hydrocarbon fractions takes place; then, the dehydrated hydrocarbon or in the form of an inverse emulsion is mixed with the solvent, and passes to a container to carry out the separation of the improved crude oil asphaltenes' and the solvent in one single stage. The solvent is recovered and recirculated to the process. Finally, the dragged solvent is separated from the asphaltenic portion. The present patent application is performed in several stages; it does not consider beheading the crude oil; and does not emulsify the crude oil.

U.S. Pat. No. 5,843,303 describes an improvement to a solvent extraction process by warming different streams of the process by convection with direct fire. Conventionally, a hot oil system is used to provide the heat requirements of the process but this patent claims the use of convection heating with direct fire. The instant application provides the required heat with the steam obtained from the combustion of the asphaltenes.

U.S. Pat. No. 6,357,526 titled "Field upgrading of heavy crude oil and bitumen" describes a process in which steam is injected to the reservoir to produce heavy oil. Later, the oil is taken to an atmospheric fractioning stage to remove the light hydrocarbons. The remaining oil is deasphalted and the improved crude oil is mixed with the light oils obtained by atmospheric distillation to obtain synthetic crude oil. The asphaltenes obtained during the deasphalting process can be converted into beads or small spheres or a slurry (residue with crude oil mud), and then burned to produce steam which is then injected into the reservoir. They also propose that a gasification process can be applied to the asphaltenes to produce synthesis gas. This patent describes a general process from injecting steam to the reservoir to the generation of steam by burning the asphaltenes, the present patent application is specific for a dehydration and deasphalting process.

U.S. Pat. No. 6,533,925, "Asphalt and resin production to integration of solvent deasphalting and gasification", describes a process where the heat generated during a gasification process and the solvent deasphalting process are integrated, and shows a process to separate the resins contained in the solvent after the deasphalting. This process consists of warming the solvent-DAO mixture with resins to precipitate the resins and separate them. Then, the solvent-DAO mixture is warmed to vaporize the solvent and separate it from the DAO. This warming is performed with heat obtained from gasification processes. Consequently, the DAO obtained is free of resins. The asphaltenes obtained during the deasphalting process are gasified.

Patent application US 2005/0167333 or application PCT WO 2005/074440, titled "Supercritical Hydrocarbon Conversion Process" describes a process applied to convert hydrocarbons with boiling points above 538° C. at supercritical conditions by using a solvent in a solvent/hydrocarbon proportion of 2/1 and at conditions above the critical temperature (371-593° C.) and the critical pressure (715-2015 psia (4929.75-13892.94 KPa)) of the solvent, in the presence of hot fluidized solids. The hydrocarbons are supplied to a reaction zone at a temperature below that of the hot solids. The hydrocarbon-solids suspension has a thermal equilibrium temperature corresponding to the reaction temperature. The conversion has high rates of sulfur, nitrogen and metals removal, nearly complete conversion to lower molecular weight hydrocarbon, high naphtha conversion, and low coke formation. According to said application, it is suggested that the supercritical conversion can replace primary and vacuum crude distillation processes, solvent deasphalting, coking, hydrocracking, hydrotreatment and the fluid catalytic cracking, or may be used in parallel with such processes.

U.S. Pat. No. 3,065,859, "Cleaning process of materials containing hydrocarbons with critical and supercritical solvents" describes a process to clean materials and consists of putting a material in contact with an extraction fluid, under nearly critical temperature and pressure conditions. The extraction fluid may be $NH_3$, aromatic compounds, nitrous oxide, water, CO, $CO_2$, alcohols, alkanes, or mixtures thereof. The process claimed in this patent application is not performed at supercritical conditions.

DESCRIPTION OF THE INVENTION

The major part of oil reserves in Colombia is of heavy and extra heavy crude oils. The light crude oils reserves are declining drastically and it is estimated that crude production in Colombia will be constituted of more than a 90% of heavy crude oils. This same trend is observed in other Latin American countries such as Ecuador, Peru, and Brazil. The heavy crude reserves in Colombia are located in the Eastern Plains and the Middle Magdalena Valley areas. Nine billion barrels in the Plains area and 1.7 billion barrels in the Middle Magdalena area are the estimated reserves of Original Oil In Place (OOIP). The refineries in Colombia are located one in the Middle Magdalena Valley and the other in the Atlantic Coast. To transport those heavy crude oils to these points or to the export sites, such as Covenas, the mountain ranges have to be crossed. The best alternative to do so is pipelining the products as road transport (tank trucks) is two or three times more expensive. To pipeline it some requirements have to be met: a viscosity lower than 300 cSt (3 $cm^2/s$) at 30° C.; an API° higher than 18; and a water content lower than an 0.5%. An option for the heavy and extra heavy crude oils to comply with those conditions is to use a solvent like naphtha. However, this adds high costs to the production and transportation process of the crude oil making them less profitable than expected.

There is the need of a dehydration process for crude oils in general to take them within water content specifications and, specifically, the application of improvement processes, such as deasphalting, is required for the heavy and extra heavy crude oils, to reduce viscosity, sulfur and metals contents. This way the production becomes viable and transportation and refining, profitable.

In the deasphalting processes asphaltenes are obtained as by-product. It is also necessary to dispose appropriately of these residues to reduce the environmental impact; the asphaltenes can be used for the production of fuel, asphalts, and high heating power fuels. In this particular case, the asphaltenes are used to cogenerate electricity.

The present patent application complies with the solution to the necessity stated above by means of a dehydration and deasphalting process to upgrade heavy and extra heavy crudes using a specific solvent consisting of a mixture of, mainly, paraffin and isoparaffin, naphthenic and some aromatic compounds. FIG. 2 describes the composition of the solvent in % vol. The paraffin and isoparaffin are mainly comprised of penthane, butane, and hexane, and a lower content of heptanes to dodecane. FIG. 3 presents the solvent's boiling curve.

The process starts with the arrival of the heavy or extra heavy crude oil, coming form the extraction wells, to the receiving distributor for the dehydration process. Part of the solvent is added as a diluent to facilitate the removal process of the water contained in the crude oil. At the end of the dehydration stage the crude has a water content of less than 0.5% and is ready to be deasphalted. In this stage, the remaining part of the solvent is added to allow the removal of the asphaltenes contained in the crude. The upgraded crude oil, which contains less sulfur, nickel, and vanadium, as well as a lower viscosity, is sent to be mixed with other crude oils for a later distillation. The asphaltenes precipitated from the crude oil are dried and sent to an electricity cogeneration process. The energy obtained covers the energy requirements of the crude oil production, dehydration and deasphaltation processes, thus reducing the environmental impact that would arise if this type of residues were not properly disposed of. Additionally, this represents a reduction in the operational costs as the energy required for the processes are obtained from one of its byproducts: the asphaltenes.

The present invention is related with a continuous process performed in two stages where the first comprises mixing one part of the solvent (in a crude oil:solvent ratio of 3:1) to dehydrate the crude and take it to specifications. The first stage consists of several stages such as the separation of free water, addition of dehydrating additives, warming the crude oil-solvents mixture, and the settling the mixture for a period of time enough to allow the production of dehydrated crude with the processing conditions to be deasphalted. The second stage or deasphalting comprises also several stages: in the first the remaining solvent is added to the dehydrated crude oil (at a crude oil:solvents ratio of 1:4,) to achieve the precipitation of the asphaltenes; this is carried out in a continuous on-line process. The solvent is added gradually, using static mixers to obtain asphaltenes of larger sizes (>20 microns); the second stage consists of taking the solvent-crude oil mixture to a separator, which has internal arrangements, as shown on FIG. 4, to separate the asphaltenes from the supernatant. These internal arrangements prevent turbulence and allow the recovery of an asphaltene-free product at the top. The supernatant contains the upgraded product and the majority of the solvents. In the third stage, this stream is subjected to a solvent recovery process (distillation). The solvent recovered is recycled to the process. The asphaltenes are removed via the bottom of the settler which also drags a small amount of deasphalted crude oil and solvents that go to the fourth stage where they enter into a flash drum where the crude and solvents dragged by the asphaltenes are recovered and sent to the distillation tower for rectification.

The process occurs at moderated pressure and temperature conditions ranging between 60 and 100 psig (414-689 K.Pa) and 60 to 100° C. (333-373° K).)

The asphaltenes produced are sent to a drying process and are subsequently fed into a fluidized bed boiler to generate steam and, consequently, cogenerate electricity. The steam and electricity requirements of the dehydration and deasphalting processes are obtained from the burning of the asphaltenes.

The present process is performed at the well's head and uses a solvent constituted of different compounds from butane to dodecane. The solvent's boiling point ranges from 27° C. and 109° C. and is constituted, mainly, of isoparaffin and paraffin, and in a smaller proportion napthenes, aromatics, olephines, and dodecane. The dehydration process is carried out by warming up the crude oil-solvent mixture at 80° C. and at a pressure of 30 psig (206.84 KPa), with the addition of demulsifying additives and a residence time, in the equipment, of 24 hours or less to obtain a crude with a water content of less than 0.5%. The deasphalting process is performed at pressure and temperature conditions of 60 to 100 psig (414-689 KPa) and 60 to 100° C. (333-373° K)), respectively.

In general, in the revised state of the art, these operation conditions are different to those proposed herein. The addition of a solvent to deasphalt is performed gradually and static mixers are used to homogenize it. This helps to obtain asphaltene particles sizes larger than those achieved when mixing crude and solvent simultaneously, thus resulting in shorter sedimentation times. In the present invention, the equipment used to separate the asphaltenes from the upgraded crude has some internal arrangements that minimize turbulence and allow to obtain asphaltene-free upgraded crude oil which favors the production of a low viscosity upgraded crude oil and with lower contents of sulfur and metals (nickel and vanadium).

In the equipment used here, as shown on FIG. 4, the stream flowing into the settler hits a plate (16) that breaks the turbulence at the entrance to the settler. The stream moves upward at 0.2 to 0.6 cm/s, which allows the precipitated asphaltenes to move to the bottom of the settler, with the aid of the differences in density among the phases. The bottom of the settler has a conical shape (22) with an inclination higher than the asphaltenes rest angle, such cone is machined to ensure an even surface to minimize asphaltene adherence to the walls of the settler. The stream moving upwards is collected by a concave collecting plate (18) with a pipe at the bottom. These facilities inside de settler make the rising and descending currents to present a laminated flow assuring an asphaltene-free top stream. Letters h1, h2, h3, h4, and h5 correspond to the different heights of the equipment and letters d2 and d3 to the diameters. This type of equipment is not reported anywhere within the patents revised in the state of the art.

The present invention combines the crude deasphalting and the dehydration processes in a stages arrangements, which occur at the well's head and use the same solvent for the two purposes.

BRIEF DESCRIPTION OF THE DRAWINGS

FIG. 5 shows conditions and resulting particles sizes of asphaltenes obtained from a single-point crude oil injection and a multi-point crude oil injection.

FIG. 6 shows the effect of different solvents for San Fernando crude oil asphaltene precipitation.

DETAILED DESCRIPTION OF THE INVENTION

Figure 1:
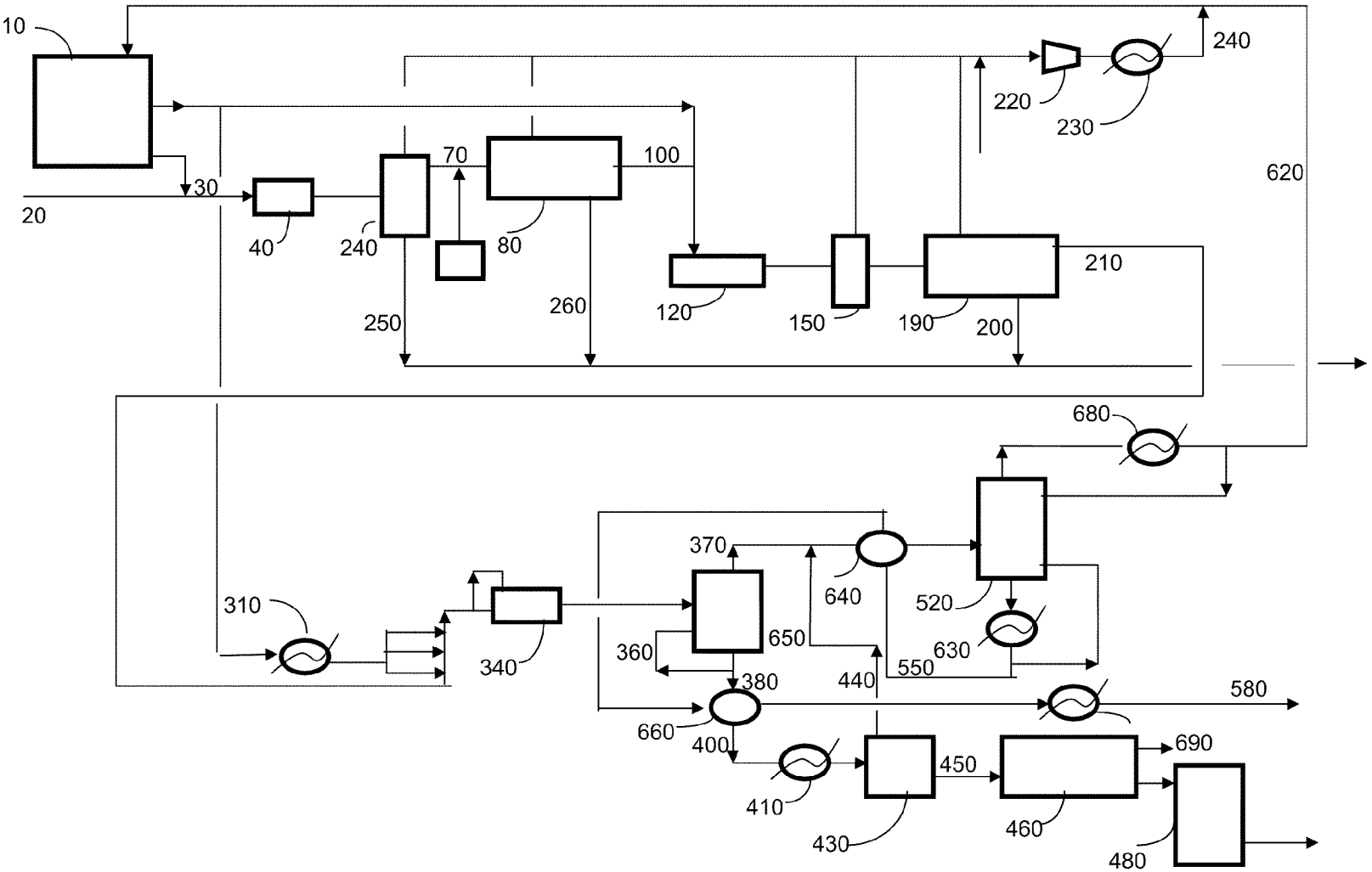
FIG. 1 shows a process for dehydration and removal of asphaltenes from heavy and extra heavy crude oils.
Figure 2:
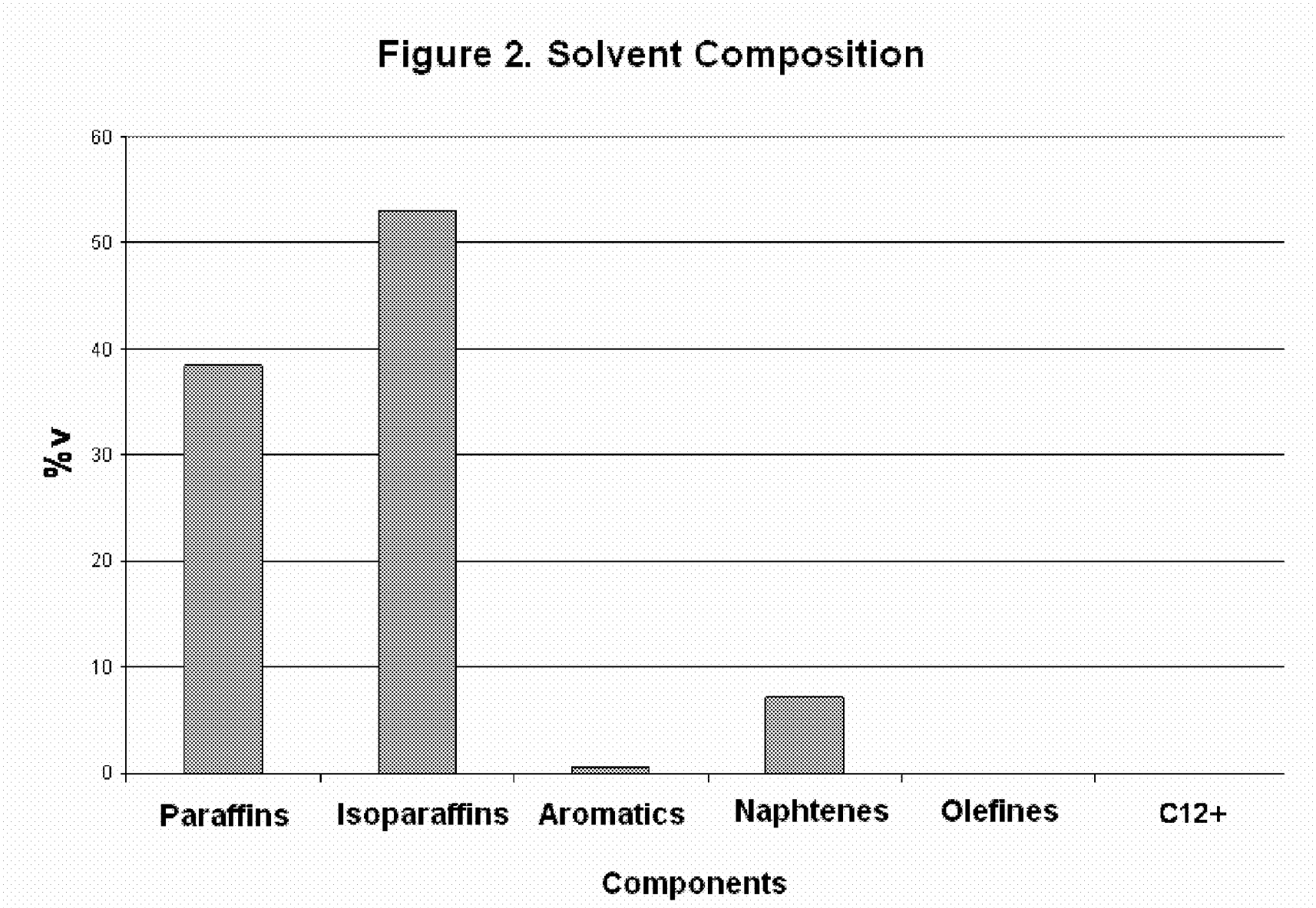
FIG. 2 shows the composition of a solvent according to the disclosure in % vol.
Figure 3:
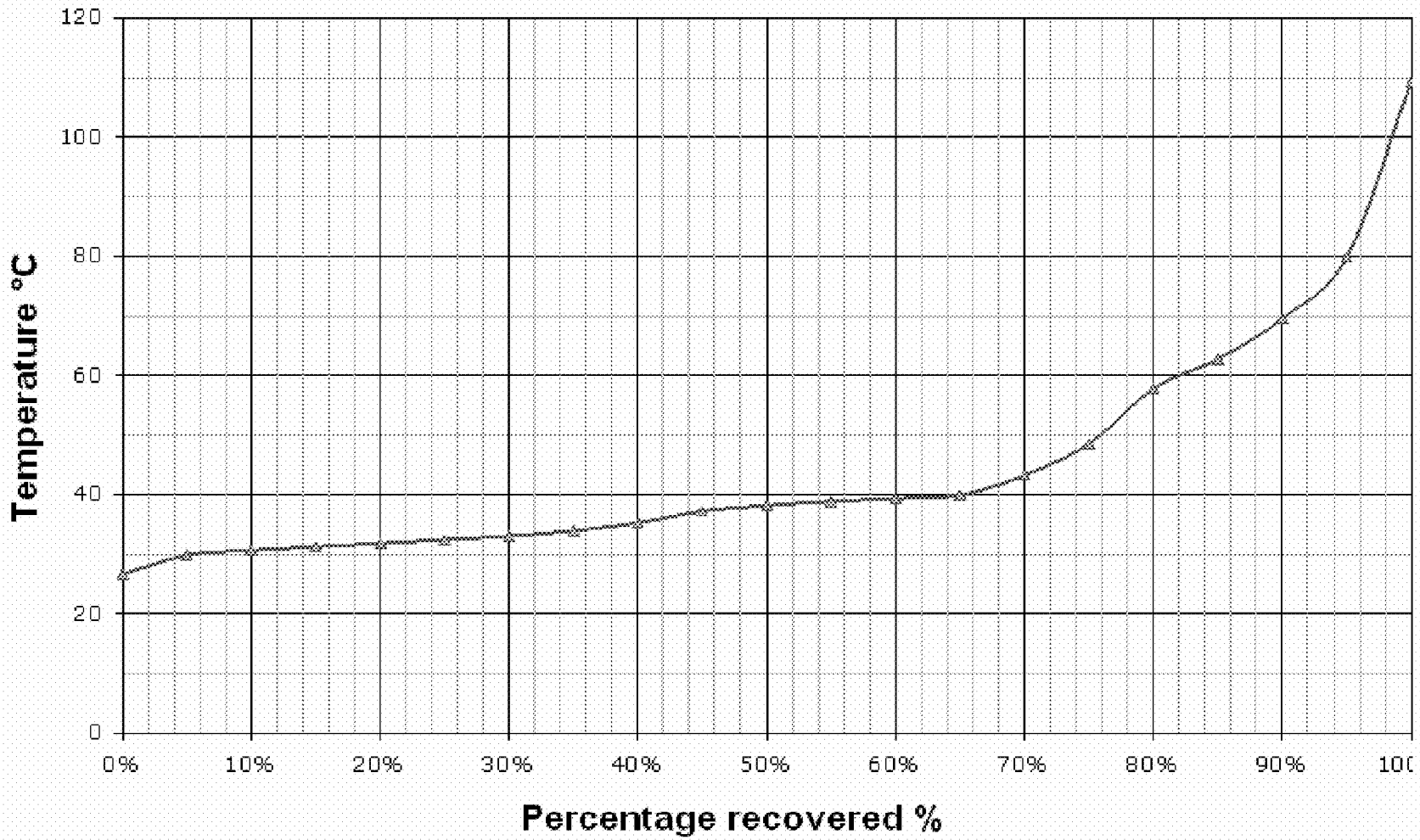
FIG. 3 shows the boiling curve of the solvent composition of FIG. 2.

FIG. 1 describes the process where the heavy or the extra heavy crude coming from the well (20) is received in the station's distributor; in this point, part of the deasphalting solvent is added to it (30) with the goal of reducing its viscosity and ease the dehydration process. The mixture passes through a series of static mixers (40) to homogenize it and is then sent to equipment (240) to remove the free water (250). Later, the mixture is injected with the necessary dehydrating additives (70) and is taken to a treatment equipment (80) to warm it up to 80° C. In this treatment equipment a major part of the emulsified water contained (260) is removed. Coming out of the treatment equipment (80) the solvent the diluted crude mixture has lost due to the warming process is added, and is passed through a series of static mixers (120) to homogenize it, it is then sent to a degasifying boot (150) and, then, to a settling tank (190) where it spends the necessary residence time to allow the water content to decrease down to 0.5% (200). All the systems operating above 30° C. are interconnected to a solvent recovery system (220), (230). The condensed light compounds (240) are sent to a solvent storage tank (10).

The dehydrated crude (210) is sent to a deasphalting stage, for this stage the solvent necessary for the deasphalting process (300) is taken, warmed (310) to 60° C. and stored at a pressure of 100 Psig (689.48 KPa). The crude/solvent ratio used is 1/4. The solvent is added gradually to the crude oil at different points, the crude-solvent mixture is sent to a system of static mixers (340) to homogenize it. Later, the mixture is sent to the settling stage. The mixture flows into the settler (650) through a feeding distribution system located at a hight of 70% of the total height of the settler.

Figure 4:
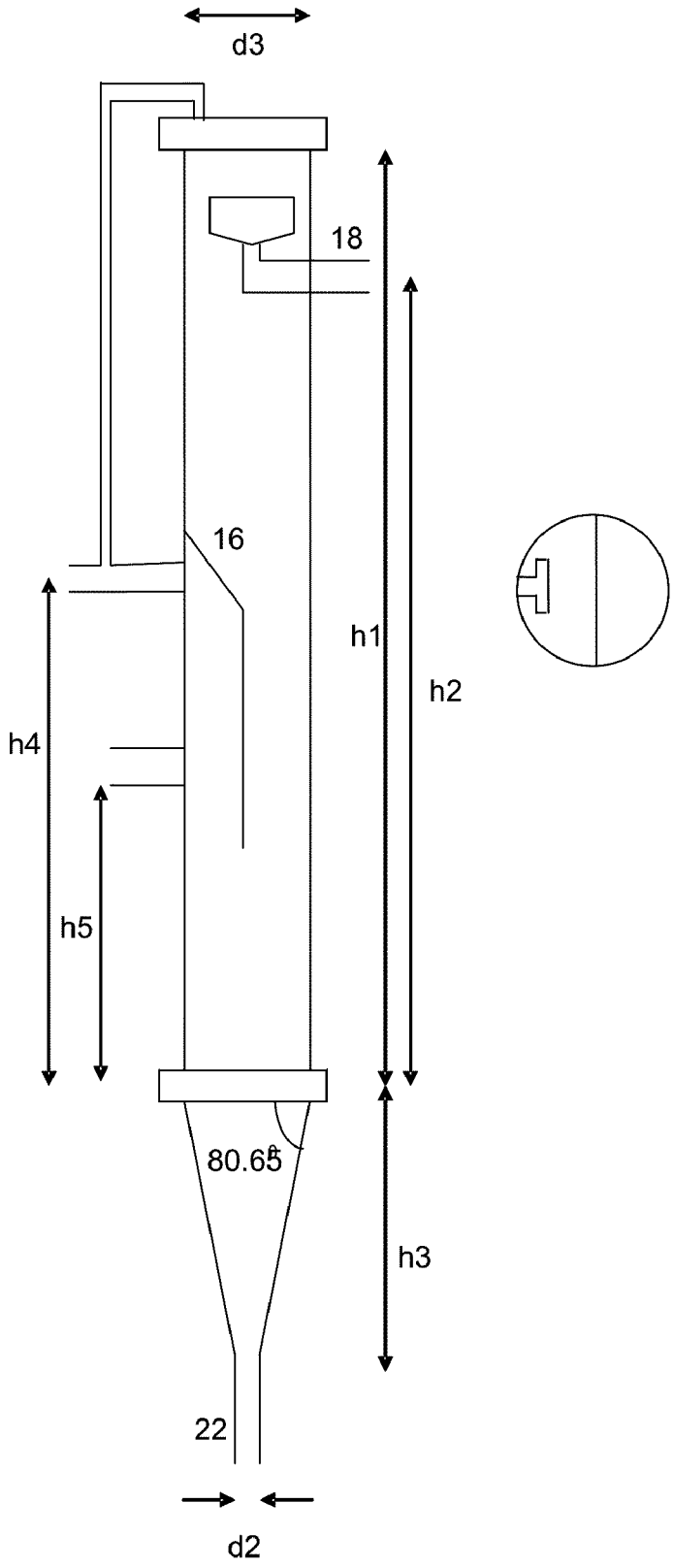
FIG. 4 shows a separator for separating asphaltenes from a solvent-crude oil mixture.

The settler (650) contains some internal arrangements described in FIG. 4. These arrangements, the entering stream distributor and the coalescing plate, allow the reduction of the incoming fluid's turbulence to facilitate the asphaltenes' sedimentation. The asphaltene-free crude oil moves toward the upper part of the settler at an ascending speed of 0.2 to 0.6 cm/s, this with the purpose of ensuring the separated asphaltenes can move toward the lower part of the settler to be removed lately. The mixture recollection system is located in the upper part of the settler, comprising a concave collecting plate with a duct in the lower part to allow the upgraded crude and most of the solvent to flow out. The deasphalted crude and solvent mixture flowing out the settler at the upper part (370) is sent to a pre-warming stage (640) before entering the solvent recovery tower (520). This pre-warming is performed exchanging heat (630) with the stream flowing out the bottom of the equipment (520). The solvent recovered is cooled (680) and sent back though line (620) to the solvent storage tank (10). The deasphalted crude leaves through the bottom via line (550) and is sent to exchange heat (640) with the stream flowing into the tower and, then, with the stream flowing out the bottom part of the settler, and then it is stored (580). The lower part of the settler (380) has a conical shape with an inclination higher than the asphaltene's rest angle to ensure they move towards the bomb managing the slurry current leaving the bottom of the settler. Part of this stream is recycled (360) to the bottom of the settler to minimize the dragging of the deasphalted crude. The other portion of the bottom stream is sent to the pre-warming stage (660) to take advantage of the deasphalted crude's remaining heat. It then passes to a warming (410) stage until it reaches a temperature high enough to allow the flash tower (430) to remove the dragged solvent and the deasphalted crude oil from the asphaltenes. The recovered deasphalted crude oil and solvent stream (440) joins to the stream flowing from the top of the settler (370) and is pre-warmed (640) before entering the solvent recovery tower (520). The asphaltenes flowing out the bottom of the tower (450) are sent to a drying and light hydrocarbon recovery system (460). These light hydrocarbons recovered (690) are then condensed and sent to mix with the deasphalted crude. The dry asphaltenes are stored in piles (480) before they are sent to the plant electricity generating plant.

EXAMPLES

Example 1

The process described in the present application was applied to an extra heavy crude oil obtained from an area of the Colombian Plains called San Fernando, with the characteristics described on Table 1. The crude was first put into contact with the solvent in a solvent/crude ratio of 1/3 in volume; it was warmed up to 82° C. and subjected to a pressure of 30 psig (206.84 KPag), and the separated water was drained out.

TABLE 1

| San Fernando Crude | |
|---|---|
| ° API | 8.7 |
| Viscosity at 30° C., Pa · s | 310 |
| Insoluble substances in nC7 | 14.95 |
| Conradson carbon, % by weight | 18.87 |
| Sulfur, % by weight | 3.4 |
| Nickel, ppm | 108 |
| Vanadium, ppm | 552 |

The operational conditions of the process applied to the dehydration and deasphalting stages are described on Table 2.

TABLE 2

| Operational Conditions | |
|---|---|
| Dehydration | |
| Incoming crude oil T, ° C. | 65 |
| Incoming crude oil P, KPa | 344.74 |
| Relation solvent/crude oil | 1/3 |
| Treatment T, ° C. | 82 |
| Treatment P, KPa | 206.84 |
| Deasphalting | |
| Solvent/crude oil ratio | 4.6/1 |
| Sedimentator P, KPa | 689.48 |
| Sedimentator T, ° C. | 60 |

The crude oil at the exit of the dehydration process showed a water content of 0.5%. The deasphalting process was applied to the dehydrated crude oil, making the crude oil/solvent ratio pass to 1/4.6 per volume. This was carried out by injecting the solvent gradually at different entrances located before the stream passes through the static mixers. The mixture flows went into the settler where the phase separation occurred. The upgraded crude oil exits the upper part of the settler, free of asphaltenes and with a major portion of the solvent. This stream is pre-warmed using the upgraded crude oil stream flowing out the bottom of the tower prior to entering to the distillation tower. The solvent recovered is recycled to the tank to be subsequently fed to the process again. The settler's bottom stream was pre-warmed before it flowed into the flash tower. The light hydrocarbons recovered in the flash tower were sent to the distillation tower for rectification. The asphaltenes flow out the flash tower at the bottom and are sent to the drying process and then to the burning process to produce the energy required by the processes.

The crude oil obtained after the deasphalting process confirms the benefits of the proposed process. The quality results of the processed crude oil are shown on Table 3.

TABLE 3

| DAO San Fernando | |
|---|---|
| ° API | 16 |
| Viscosity at 30° C., Pa · s | 1.87 |
| Conradson carbon, % by weight | 10.48 |
| Sulfur, % by weight | 2.4 |
| Nickel, ppm | 45 |
| Vanadium, ppm | 184 |

Note that the application of the process produced a reduction of a 99.4% in the viscosity, a 30% by weight in the content of sulfur, a 58% by weight in the content of nickel, and a 67% by weight in the content of vanadium. Moreover, the ° API value increased 84%. Crude oil of such quality increases its value and the transportation and refining become less expensive.

Example 2

A heavy crude oil obtained from a region of the Colombian Plains called Castilla was used. The viscosity characteristics of this crude oil make it difficult to pipeline it to the refining or export sites. The main characteristics of this crude oil are shown on Table 4.

TABLE 4

| Castilla Crude oil | |
|---|---|
| ° API | 12.8 |
| Viscosity at 30° C., Pa · s | 7.2 |
| Insoluble substances in nC7 | 14.09 |
| Conradson carbon, % by weight | 15.6 |
| Sulfur, % by weight | 2.4 |
| Nickel, ppm | 97 |
| Vanadium, ppm | 355 |

The process conditions of the dehydration and deasphalting stages are described on Table 5.

TABLE 5

| Operational Conditions | |
|---|---|
| Dehydration | |
| Incoming crude oil T, ° C. | 60 |
| Incoming crude oil P, KPa | 310.26 |
| Relation solvent/crude oil | 1/5 |
| Treatment T, ° C. | 80 |
| Treatment P, KPa | 206.84 |
| Deasphalting | |
| Relation solvent/crude oil | 4.8/1 |
| Settler P, KPa | 551.58 |
| Settler T, ° C. | 60 |
| Water and sediment contents in a crude oil sample at the exit | 0.45 |

Once the dehydration process was applied, the crude oil sample showed a content of water and sediment equivalent to 0.45%. The processed crude oil quality results are shown on Table 6.

TABLE 3

| DAO Castilla | |
|---|---|
| ° API | 19 |
| Viscosity at 30° C., Pa · s | 0.07 |
| Conradson carbon, % by weight | 6.1 |
| Sulfur, % by weight | 1.7 |
| Nickel, ppm | 22 |
| Vanadium, ppm | 85 |

This process showed an increase in the API degree of 48% and a reduction in viscosity of 99%, as well as a reduction of 29% by weight in the content of sulfur and a 77% by weight in the contents of nickel and vanadium. The upgraded crude oil complies with the necessary conditions to be pipelined (<300 cSt (3 cm2/s))

Example 3

Runs were performed with Castilla Crude oil under two conditions. For the first condition, Castilla Crude oil was mixed with the solvent at a single point, before the static mixer. For the second condition, Castilla crude oil was added gradually to the solvent at different points before the mixer and during the mixing. The arrangement of the studied conditions and the resulting particle sizes of the asphaltenes obtained are shown in FIG. 5.

Larger asphaltenes particle sizes are obtained by injecting crude oil at different points—30 microns—than when it is done at one single point −9 microns. This is beneficial as it requires a shorter residence time in the settler to achieve the separation of the upgraded crude oil's asphaltenes or higher ascending speeds of the current flowing out at the upper part of the settler; consequently, this implies a shorter size of the settler.

Example 4

Different solvents were tested to deasphalt San Fernando crude oil; the characteristics of this crude oil are described on Table 1. The deasphalting process was performed at the same temperature and pressure conditions, varying the crude oil/solvent ratio for all the solvents.

The outcome of the test is shown in FIG. 6.

The larger amount of asphaltene removal is achieved with the solvent; it is also observed that no solvent/crude oil ratios above 5/1 are required, because the maximum asphaltenes removal is achieved at this value.

The invention claimed is:

1. A process for dehydration and removal of asphaltenes from heavy and extra heavy crude oil oils, which is carried out in two phases: the first phase comprises addition of solvent, removal of free water, warming, addition of emulsion breaking additives, and settling to remove the emulsified water; said first phase is performed at 80° C. and 207 KPa (353° K and 30 psi); and a second phase, where the removal of asphaltenes is performed in a settler; then, the solvent is recovered and recycled to the process; this second phase takes place at pressure and temperature conditions of up to 689 KPa (100 psi) and 80° C. (353° K), respectively.

2. The process described in claim 1 which is carried out at the well's head.

3. The process described in claim 1 wherein the heavy crude oils treated during the dehydration stage have a gravity under 13° API.

4. The process described in claim 1 wherein the extra heavy crude oils treated during the dehydration stage have a gravity under 10° API.

5. The process described in claim 1 wherein the crude oils the have a gravity under 13° API.

6. The process described in claim 1 wherein the crude oil/solvent ratio for the dehydration process is of 3/1; and for the crude oil deasphalting is of 1/5.

7. The process described in claim 1 wherein the solvent required for the deasphalting process is applied in line and gradually.

8. The process described in claim 1 wherein the precipitated asphaltenes have a particle size larger than 30 microns.

9. The process described in claim 1 wherein the settler to remove the asphaltenes comprises a plate to break the turbulence at the settler's entrance, a conical shaped bottom with an inclination higher than the asphaltenes' rest angle; the cone is machined to ensure an even surface that minimizes asphaltenes adherence to the walls of the settler, and a concave collecting plate (18) with a duct in the lower part, located at the upper part of the settler.

10. The process described in claim 1, wherein the solvent consists of a mixture formed, mainly, of paraffins and isoparaffins, naphthenic compounds and some aromatics.

11. The process described in claim 1 wherein the paraffins and isoparaffins are constituted, mainly, of pentane, butane, hexane, and, in a lower content, from heptanes to dodecanes.

12. The process described in claim 1 wherein the asphaltenes obtained are burned to produce the necessary steam and electricity for the processes.

* * * * *